US009428920B2

(12) United States Patent
Schluter et al.

(10) Patent No.: US 9,428,920 B2
(45) **Date of Patent: *Aug. 30, 2016**

(54) VENEER UNDERLAYMENT

(71) Applicant: Schluter Systems L.P., Plattsburgh, NY (US)

(72) Inventors: Werner Schluter, Iserlohn (DE); Stefan Weige, Iserlohn (DE)

(73) Assignee: Schluter Systems L.P., Plattsburgh, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/523,557

(22) Filed: Oct. 24, 2014

(65) Prior Publication Data

US 2015/0167321 A1 Jun. 18, 2015

Related U.S. Application Data

(63) Continuation of application No. 13/612,527, filed on Sep. 12, 2012, now Pat. No. 8,950,141.

(51) Int. Cl.
*E04F 15/18* (2006.01)
*E04F 15/022* (2006.01)
(Continued)

(52) U.S. Cl.
CPC ..... *E04F 15/182* (2013.01); *E04F 15/022* (2013.01); *E04F 15/02194* (2013.01); *E04F 15/082* (2013.01); *E04F 15/185* (2013.01)

(58) Field of Classification Search
CPC ..... E04F 15/18; E04F 15/02; E04F 15/182; E04F 15/02194; E04F 15/082; E04F 15/185; E04F 15/022; E02D 31/02; E04B 5/48
USPC ..... 52/390, 385, 386, 388, 449, 450, 453, 52/454, 391; 237/69, 56, 59, 8 A
See application file for complete search history.

(56) References Cited

U.S. PATENT DOCUMENTS 2,956,785 A * 10/1960 Richl ..... F24D 5/10 165/56
3,434,401 A 3/1969 Kiewit
(Continued)

FOREIGN PATENT DOCUMENTS

CA 2087055 A1 7/1994
CA 2317985 A1 3/2001
(Continued)

OTHER PUBLICATIONS

Exhibit B-1 "To Progress Profiles SPA's and Progress Profiles America's Response to Schluter Systems L.P's First Set of Interrogatories," pursuant to *Imre Baton and Progress Profiles SPA* vs. *Schluter Systems L.P.*, Civil Action No. 1:15-cv-00144-CMH-IDD, presented Aug. 31, 2015, 8 pages.
(Continued)

*Primary Examiner* — James Ference
(74) *Attorney, Agent, or Firm* — Thorpe North & Western

(57) ABSTRACT

An underlayment includes a base layer having a base elevation and a series of individual supports extending upwardly from the base layer and being configured to create voids in a layer of bonding material used to adhere the veneer material to the underlayment. Each of the individual supports includes: at least one outer wall extending upwardly from the base layer and terminating at an upper lip, a bowl area defined adjacent a center of each of the individual supports and having a foot support defined at a bottom of the bowl area; and an internal wall extending downwardly and inwardly from the upper lip toward the foot support. An elevation of the foot support is substantially the same as an elevation of the base layer immediately adjacent the outer wall of each of the individual supports.

15 Claims, 3 Drawing Sheets

(51) Int. Cl.
*E04F 15/02* (2006.01)
*E04F 15/08* (2006.01)

(56) References Cited

U.S. PATENT DOCUMENTS

| | | | | |
|---|---|---|---|---|
| 4,016,692 | A | 4/1977 | Jordan et al. | |
| 4,640,067 | A | 2/1987 | Hagemann et al. | |
| 4,640,854 | A * | 2/1987 | Radtke | 428/34.1 |
| 4,923,733 | A | 5/1990 | Herbst | |
| 5,052,161 | A | 10/1991 | Whitacre | |
| 5,105,595 | A * | 4/1992 | Tokei et al. | 52/381 |
| 5,374,466 | A * | 12/1994 | Bleasdale | 428/131 |
| 5,386,670 | A * | 2/1995 | Takeda | E04F 15/02411 52/126.6 |
| 5,480,259 | A | 1/1996 | Thrower | |
| 5,489,462 | A * | 2/1996 | Sieber | 428/174 |
| 5,499,476 | A * | 3/1996 | Adams et al. | 52/220.1 |
| 7,250,570 | B1 | 7/2007 | Morand et al. | |
| 8,176,694 | B2 | 5/2012 | Batori | |
| 8,288,689 | B1 | 10/2012 | Adelman | |
| 8,950,141 | B2 | 2/2015 | Schluter et al. | |
| 9,188,348 | B2 | 11/2015 | Larson | |
| 2009/0026192 | A1 | 1/2009 | Fuhrman | |
| 2009/0230113 | A1 | 9/2009 | Batori | |
| 2011/0047907 | A1 | 3/2011 | Smolka et al. | |
| 2016/0010327 | A1 | 1/2016 | Larson | |
| 2016/0033144 | A1 | 2/2016 | Larson | |

FOREIGN PATENT DOCUMENTS

| | | | |
|---|---|---|---|
| CA | 2420097 | A1 | 8/2003 |
| CA | 2456682 | A1 | 8/2005 |
| CA | 2518285 | A1 | 3/2006 |
| CA | 2533062 | A1 | 7/2007 |
| DE | 2840149 | A1 | 3/1980 |
| DE | 3317131 | A1 | 11/1984 |
| DE | 3730144 | A1 | 4/1988 |
| DE | 3910629 | A1 | 10/1990 |
| DE | 3916302 | A1 | 11/1990 |
| DE | 202006013453 | U1 | 11/2006 |
| EP | 0371268 | B1 | 2/1993 |
| EP | 0561538 | A1 | 9/1993 |
| EP | 1054217 | A2 | 11/2000 |
| EP | 1063478 | B1 | 10/2003 |
| EP | 1460345 | A1 | 9/2004 |
| EP | 1712695 | B1 | 10/2006 |
| FR | 2746426 | A1 | 9/1997 |
| GB | 2214947 | A | 9/1989 |
| WO | WO 82/03099 | A1 | 9/1982 |
| WO | WO 86/02120 | | 4/1986 |
| WO | WO 87/03324 | A1 | 6/1987 |
| WO | WO 88/00997 | A1 | 2/1988 |
| WO | WO 93/14286 | A1 | 7/1993 |
| WO | WO 9522671 | A1 | 8/1995 |
| WO | WO 99/55985 | A1 | 11/1999 |
| WO | WO 2009/110934 | | 9/2009 |

OTHER PUBLICATIONS

Exhibit B-2 "To Progress Profiles SPA's and Progress Profiles America's Response to Schluter Systems L.P's First Set of Interrogatories," pursuant to *Imre Baton and Progress Profiles SPA* vs. *Schluter Systems L.P.,* Civil Action No. 1:15-cv-00144-CMH-IDD, presented Aug. 31, 2015, 10 pages.

Exhibit B-3 "To Progress Profiles SPA's and Progress Profiles America's Response to Schluter Systems L.P's First Set of Interrogatories," pursuant to *Imre Baton and Progress Profiles SPA* vs. *Schluter Systems L.P.,* Civil Action No. 1:15-cv-00144-CMH-IDD, presented Aug. 31, 2015, 7 pages.

Exhibit B-4 "To Progress Profiles SPA's and Progress Profiles America's Response to Schluter Systems L.P's First Set of Interrogatories," pursuant to *Imre Baton and Progress Profiles SPA* vs. *Schluter Systems L.P.,* Civil Action No. 1:15-cv-00144-CMH-IDD, presented Aug. 31, 2015, 7 pages.

* cited by examiner

VENEER UNDERLAYMENT

PRIORITY CLAIM

This application is a continuation of U.S. patent application Ser. No. 13/612,527, filed Sep. 12, 2012, which is hereby incorporated herein by reference in its entirety.

FIELD OF THE INVENTION

The present invention relates generally planar support structures for use in veneer applications. While not so limited, the present invention is well suited for use in tiling and stone applications on floors, ceilings and walls.

BACKGROUND OF THE INVENTION

Centuries ago, European builders developed a reliable method of installing tile for high-traffic, high-use applications which relied upon a layer of "sand strata" between a structural substrate and a mortar-bed/tile composite top layer. Modern theory explains that the sand strata "uncouples" the tile from the structure, allowing structural movement without damage to the tile layer. However, due to space (height) requirements and other concerns, the sand strata method for tile installation is, for all practical purposes, extinct.

Approximately twenty-five years ago, a modern analog of the sand strata system was developed in which a thin, polyethylene sheet membrane functions as the uncoupling layer. This product, sold under the tradename DITRA, included a grid structure of square, cutback cavities and an anchoring fleece laminated to its underside. This membrane allows the normal loading forces exerted on the tile surface to be widely distributed through a forgiving shear plane, similar to that which would be expected in the sand strata. The resulting affect contradicted conventional theory which suggests that extremely strong bonds are necessary between the tile and the substrate to maintain a crack-free tile surface.

In fact, however, this system illustrated that a relatively weak interface is more forgiving, allowing substantial movement in the substrate without any evidence of cracking in the tile or the grout joints. This system also allows differential expansion and contraction between the tile and the substrate and can be used on a wide range of substrates which have traditionally been viewed as problematic; including plywood, OSB, post-tensioned concrete slabs, green concrete, radiant heated floors, and gypsum underlayments.

A direct, force-conductive bond of rigid materials such as ceramic or porcelain tile and stone is not suitable, since these surface materials are sensitive to tensile stresses, particularly when also exposed to live and dead loads. This fact becomes increasingly relevant since the formats of tile and stone are dramatically increasing in size. Twenty-five years ago, a 300 mm×300 mm (12"×12") tile was considered very large. Today, formats of 900 mm×900 mm (3'×3') are commonly used and many modern manufacturers offer large formats up to 1200 mm×3000 mm (4'×10').

While the DITRA product performs well in many environments, the present inventors have improved on this revolutionary concept.

SUMMARY OF THE INVENTION

In accordance with one aspect of the invention, an underlayment for use between a veneer material and a foundation surface is provided. The underlayment can include a base layer and a series of individual supports extending upwardly from the base layer and being configured to create voids in a layer of bonding material used to adhere the veneer material to the underlayment. Each of the individual supports can include: at least one outer wall extending upwardly from the base layer and terminating at an upper lip the upper lip comprising a plurality of linear segments; a bowl area defined adjacent a center of each of the individual supports; and an internal wall extending downwardly and inwardly from the upper lip toward the center of each of the individual supports to at least partially define the bowl area within each of the individual supports. The internal wall can include a plurality of surfaces, each surface extending from one of the plurality of linear segments of the upper lip and having a contour that substantially matches the linear segment from which each surface extends.

In accordance with another aspect of the invention, an underlayment for use between a veneer material and a foundation surface is provided. The underlayment can include a base layer having a base elevation and a series of individual supports extending upwardly from the base layer and being configured to create voids in a layer of bonding material used to adhere the veneer material to the underlayment. Each of the individual supports can include: at least one outer wall extending upwardly from the base layer and terminating at an upper lip; a bowl area defined adjacent a center of each of the individual supports and having a foot support defined at a bottom of the bowl area; and an internal wall extending downwardly and inwardly from the upper lip toward the foot support to at least partially define the bowl area within each of the individual supports. An elevation of the foot support can be substantially the same as an elevation of the base layer immediately adjacent the outer wall of each of the individual supports.

There has thus been outlined, rather broadly, relatively important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

DETAILED DESCRIPTION

Figure 1:
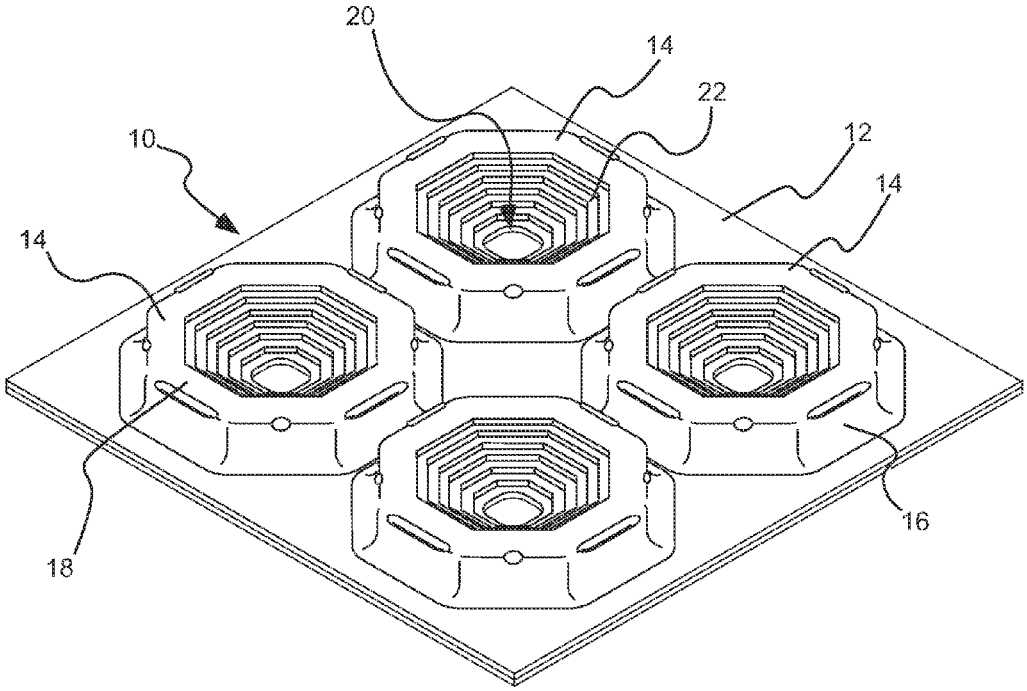
FIG. 1 is a top, perspective view of a segment of an underlayment in accordance with an embodiment of the invention.
Figure 2:
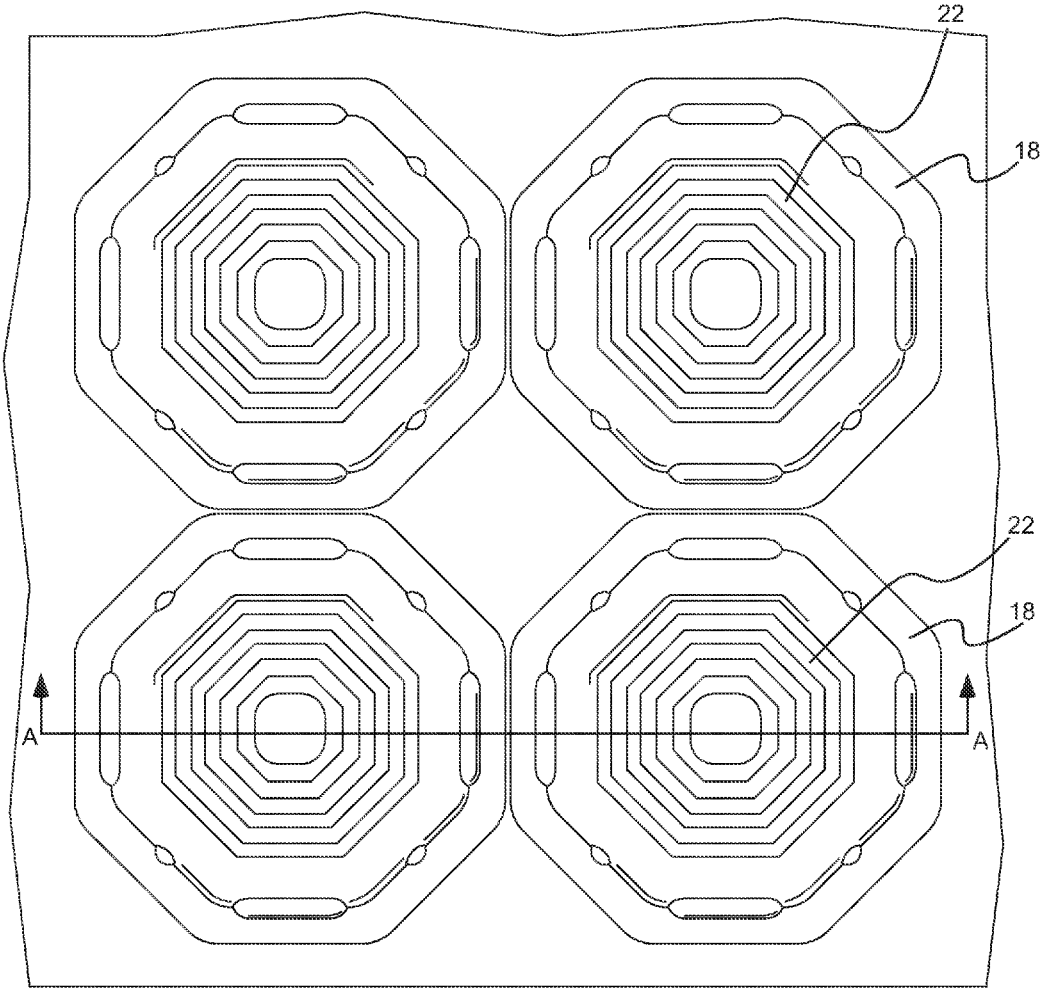
FIG. 2 is a top view of the segment of underlayment of FIG. 1.
Figure 3:
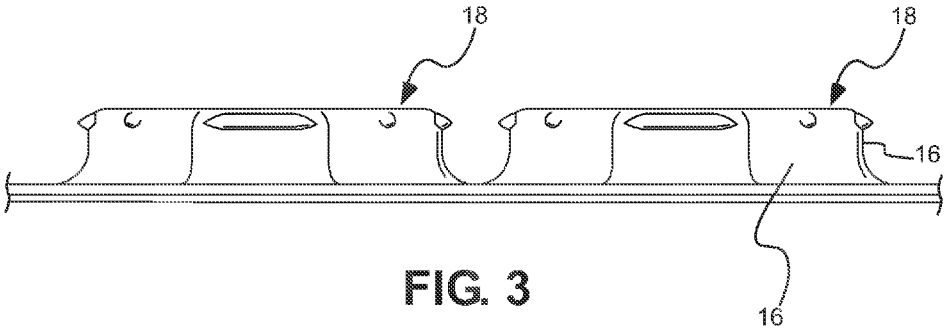
FIG. 3 is a side view of the segment of underlayment of FIG. 1.

Before the present invention is disclosed and described, it is to be understood that this invention is not limited to the particular structures, process steps, or materials disclosed herein, but is extended to equivalents thereof as would be recognized by those of ordinarily skilled in the relevant arts. It should also be understood that terminology employed herein is used for the purpose of describing particular embodiments only and is not intended to be limiting.

It must be noted that, as used in this specification and the appended claims, the singular forms "a" and "the" include plural referents, unless the context clearly dictates otherwise. Thus, for example, reference to a "support" can include one or more of such "supports."

DEFINITIONS

In describing and claiming the present invention, the following terminology will be used in accordance with the definitions set forth below.

As used herein, the term "veneer" is to be understood to refer broadly to a variety of materials that can be applied to floors, walls and ceilings and other structures to provide a decorative or protective finish to such structures. Examples of veneer material include, without limitation, ceramic tiles, natural or agglomerated stone tiles, glass tiles, or cementitious or epoxy terrazzo.

As used herein, the terms "upper," "lower," "elevation," "height," and the like, are to be understood to refer to relative locations and/or displacements of various elements or components relative to a condition in which a veneer system is oriented in its usable orientation. These terms are used to more clearly claim and describe the various elements or components of the invention and, unless the context clearly indicates otherwise, are not to be construed as limiting the invention to any particular embodiment.

As used herein, the term "substantially" refers to the complete or nearly complete extent or degree of an action, characteristic, property, state, structure, item, or result. As an arbitrary example, an object that is "substantially" enclosed is an object that is either completely enclosed or nearly completely enclosed. The exact allowable degree of deviation from absolute completeness may in some cases depend on the specific context. However, generally speaking the nearness of completion will be so as to have the same overall result as if absolute and total completion were obtained.

The use of "substantially" is equally applicable when used in a negative connotation to refer to the complete or near complete lack of an action, characteristic, property, state, structure, item, or result. As an arbitrary example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

INVENTION

As illustrated by example in the figures, the present invention generally provides an underlayment that can be utilized in a variety of applications in which a veneer material, such as ceramic tile or stone, is applied over a foundation surface, such as concrete, wood, engineered wood products, and the like. While not so limited, the underlayment can be formed from a generally pliable material including, without limitation, plastic such as polyethylene or polypropylene, metal, fabric, or a composite of different materials that allow deformation, maintain shape during installation, and result in a substantially incompressible interface between the veneer material and the foundation surface. In some embodiments, a bondable fleece or similar liner can be attached to a bottom surface of the underlayment to aid in bonding the underlayment to the foundation surface.

While the underlayment and related systems disclosed herein can be used in a variety of veneer applications, including those on floors, walls and ceilings, in the interest of simplicity, the discussion herein will focus on use of the system with ceramic tiles installed in a flooring application. It is to be understood, however, that the invention is not so limited.

The underlayment generally allows typical loading forces exerted on the tile surface to be widely distributed through a forgiving shear plane, similar to that which would be expected in the sand strata discussed above in the background section. Use of the present system can provide a relatively weak interface between the foundation surface and the tile. This interface is more forgiving, allowing substantial movement in the substrate without any evidence of cracking in the tile or the grout joints. The present system also allows differential expansion and contraction between the tile and the substrate and can be used on a wide range of substrates which have traditionally been viewed as problematic; including plywood, OSB, post-tensioned concrete slabs, green concrete, radiant heated floors, and gypsum underlayments, to name a few.

Figure 4:
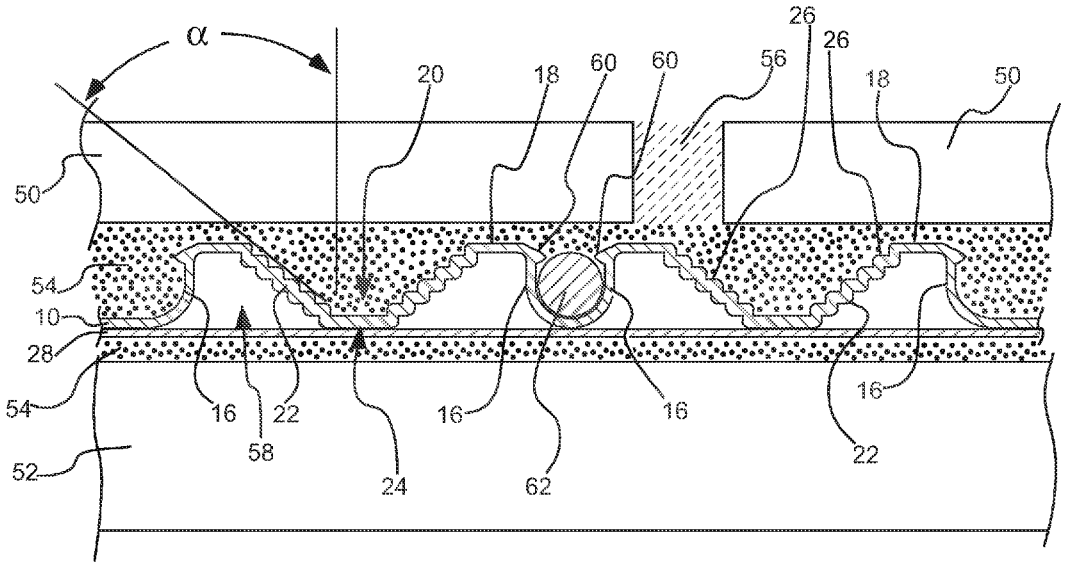
FIG. 4 is a sectional view of the underlayment of FIG. 1, taken along section A-A of FIG. 2 and shown installed as part of a tile installation with a heating element engaged between two adjacent supports.

Turning now to the figures, in one aspect of the invention, an underlayment 10 is provided for use between a veneer material (see, e.g., tile 50 in FIG. 4) and a foundation surface (see, e.g., foundation surface 52 in FIG. 4). The underlayment can include a base layer 12 and a series of supports 14 that can extend upwardly from the base layer. The supports can be configured to create voids in the layer of adhesive bonding material used to adhere or bond the veneer material to the underlayment. These voids can weaken (or make less rigid) the interface between the generally very rigid veneer materials and the foundation surface. In the figures (particularly FIG. 4), these voids are represented by the space consumed by the supports in layer 54 of adhesive material. The present inventors configured these supports to improve dramatically over the original DITRA design. The volume and geometry of the bowl or cavity of the supports is optimized to correspondingly optimize the uncoupling capabilities of the underlayment, while maintaining (and potentially increasing) the ability to sustain loads.

Thus, the present design provides a forgiving interface beneath the veneer with greater ability to flex under load conditions where flexing is desirable, yet provides greater rigidity under load conditions where rigidity is more desirable. The resulting design, in essence, performs better in both loading conditions.

Each of the supports can include at least one outer wall 16 that can extend upwardly from the base layer and can terminate at an upper lip 18. A bowl area 20 can be defined adjacent a center of the support. The bowl area can be at least partially defined by an internal wall 22 that can extend downwardly from the upper lip toward the center of the support.

While the segments of the underlayment 10 shown in the figures include four supports 14, the underlayment will typically be provided in relatively large sheet rolls (on the order of one meter in width by as much as thirty meters in length) or sheet panels (on the order of one meter in width by as much as one meter twenty centimeters in length), with a great many of the supports 14 arrayed across the sheet. While not limiting the invention, to provide a general idea of the size of the supports, in one aspect the supports measure approximately one inch in width, and include a height of about 3/16 of an inch. The upper lip can include a width of about 1/8 of an inch.

In some embodiments, the outer wall 16 will extend substantially completely around a perimeter of each of the supports to define a closed geometry. In one aspect, the internal wall 22 slopes generally downwardly and inwardly from the upper lip 18 toward a center of the bowl area. Thus, the internal wall can define a conic cavity or bowl 20 that is at least partially circumscribed by the outer wall, and can be fully circumscribed by the outer wall. As best appreciated from FIG. 4, the conic cavity so defined can include at least one wall that forms an angle $\alpha$ relative to a center axis of the conic cavity. The angle $\alpha$ can vary: in one embodiment the angle measures from about 40 degrees to about 80 degrees. In another embodiment, the angle measures about 60 degrees.

Referring still to FIG. 4, the internal wall 22 that defines or forms the bowl or conic cavity 20 can extend downwardly and inwardly and can terminate at a support foot 24 that is supported at or from an elevation that is substantially level with the base layer of the underlayment. In this manner, loads carried by the adhesive or bonding material within the bowl area are transferred to substantially the same surface to which the base 12 of the underlayment is bonded.

While the cavity or bowl 20 is shown in the figures terminating flush with the base of the underlayment, it is also contemplated that the cavity can be formed with less of a depth, and the support foot can include a significantly larger height that will transfer the load carried by the support to the underlying foundation surface 52. Also, a spacer or other suitable blocking material (not shown) can be installed between the support foot and the underlying foundation surface.

As best appreciated from FIG. 4, the internal wall 22 can include a series of stepped plateaus or corrugations 26 formed therein. The steps or corrugations serve to provide greater flexibility to the wall, improve mechanical bond between dry-set mortar 54 and the underlayment, and increase the overall surface area of the internal wall.

FIG. 4 illustrates an application of the present system in which the underlayment is installed as a component of a veneer installation. The installation includes foundation surface 52 to which the underlayment is bonded via dry-set mortar or other suitable adhesive or bonding material 54. A bondable fleece or other liner material 28 can be bonded beneath the underlayment to increase the effectiveness of the bond between the underlayment and the foundation surface. Where applicable, the same dry-set mortar material 54 can be applied over the underlayment to secure tiles 50 to the underlayment. Grout 56 can then be applied between the tiles, as is well known in the art.

It will thus be appreciated that a hollow cavity 58 is defined beneath the internal wall 22 and above the liner material (when such is present) that remains hollow even after application of the tiles. This hollow space allows the supports 14 to flex in response to static and dynamic loads applied to the tiles to prevent cracking of the tiles and the grout, even in cases where such applied loads cause deflection of the foundation surface 52.

The supports 14 can include one or more protrusions 60 that can extend at least partially laterally from the outer wall of the support. The protrusion can thus create an overhang beneath which an open space is defined. The open space can advantageously trap or capture mortar (or other adhesive material) beneath the overhang, aiding in maintaining bonding of the underlayment to the foundation surface. Also, as shown in FIG. 4, two adjacent protrusions 60 extending from outer walls 16 can create a space within which a heating element 62 can be fitted. Thus, the present underlayment can be utilized in applications where it is desired to run electric or hydronic heating or cooling lines, or the like, beneath a tile installation.

In addition to the structural features described above, the present invention also provides various methods of forming, installing, and configuring underlayment systems in accordance with techniques known to those of ordinary skill in the art having possession of this disclosure.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

The invention claimed is:

1. An underlayment for use between a veneer material and a foundation surface, the underlayment comprising:

a base layer;

a series of individual supports extending upwardly from the base layer and being configured to create voids in a layer of bonding material used to adhere the veneer material to the underlayment, each of the individual supports including:

at least one outer wall extending upwardly from the base layer and terminating at an upper lip;

a protrusion extending from the outer wall to form an overhang beneath which a heating element can be fitted;

a bowl area defined adjacent a center of each of the individual supports and having a foot support defined at a bottom of the bowl area;

an internal wall extending downwardly and inwardly from the upper lip toward the foot support to at least partially define the bowl area within each of the individual supports; and a hollow space defined between the internal wall and the external wall; wherein an elevation of a bottom surface of the foot support is the same as an elevation of a bottom surface of the base layer.

2. The underlayment of claim 1, wherein the outer wall extends substantially completely around a perimeter of each of the supports.

3. The underlayment of claim 1, wherein the internal wall includes a series of stepped plateaus formed therein.

4. The underlayment of claim 1, wherein the internal wall includes a series of corrugations formed therein.

5. The underlayment of claim 1, wherein the internal wall defines a conic cavity at least partially circumscribed by the outer wall.

6. The underlayment of claim 5, wherein the conic cavity includes at least one wall that defines a plane that is angled from 40 degrees to 80 degrees from a center axis of the conic cavity.

7. The underlayment of claim 5, wherein the conic cavity includes at least one wall that defines a plane that is angled from 50 degrees to 70 degrees from a center axis of the conic cavity.

8. The underlayment of claim 1, further comprising a liner material bonded to an undersurface of the base layer.

9. The underlayment of claim 1, wherein the upper lip includes a series of linear segments, and wherein the internal wall comprises a plurality of surfaces, each of the plurality of surfaces extending from one of the plurality of linear segments of the upper lip.

10. An underlayment for use between a veneer material and a foundation surface, the underlayment comprising:

a base layer;

a series of individual supports extending upwardly from the base layer and being configured to create voids in a layer of bonding material used to adhere the veneer material to the underlayment, each of the individual supports including:

at least one outer wall extending upwardly from the base layer and terminating at an upper lip;

a protrusion extending from the outer wall to form an overhang beneath which a heating element can be fitted;

a conic bowl area defined adjacent a center of each of the individual supports and having a foot support defined at a bottom of the bowl area; and an internal wall extending downwardly and inwardly from the upper lip toward the foot support to at least partially define the conic bowl area within each of the individual supports, the internal wall providing a surface to which bonding material applied between the veneer material and the underlayment can be applied; wherein an elevation of a bottom surface of the foot support is the same as an elevation of a bottom surface of a portion of the base layer located immediately adjacent the outer wall of each of the individual supports.

11. The underlayment of claim 10, further comprising a hollow space defined between the internal wall and the external wall.

12. The underlayment of claim 11, wherein the hollow space remains hollow after bonding material is applied between the veneer material and the underlayment.

13. The underlayment of claim 10, wherein the upper lip includes a series of linear segments, and wherein the internal wall comprises a plurality of surfaces, each of the plurality of surfaces extending from one of the plurality of linear segments of the upper lip.

14. An underlayment for use between a veneer material and a foundation surface, the underlayment comprising:

a base layer;

a series of individual supports extending upwardly from the base layer and being configured to create voids in a layer of bonding material used to adhere the veneer material to the underlayment, each of the individual supports including:

at least one outer wall extending upwardly from the base layer and terminating at an upper lip;

a protrusion extending from the outer wall to form an overhang beneath which a heating element can be fitted;

a bowl area defined adjacent a center of each of the individual supports and having a foot support defined at a bottom of the bowl area;

an internal wall extending downwardly and inwardly from the upper lip toward the foot support to at least partially define the bowl area within each of the individual supports; and a hollow space defined between the internal wall and the external wall; wherein the upper lip includes a series of linear segments, and wherein the internal wall comprises a plurality of surfaces, each of the plurality of surfaces extending from one of the plurality of linear segments of the upper lip; and wherein an elevation of a bottom surface of the foot support is the same as an elevation of a bottom surface of the base layer.

15. The underlayment of claim 14, wherein the internal wall provides a surface to which bonding material between the veneer material and the underlayment can be applied.

* * * * *